US010086617B2

(12) United States Patent
Shimmachi et al.

(10) Patent No.: US 10,086,617 B2
(45) Date of Patent: Oct. 2, 2018

(54) PRINTING APPARATUS

(71) Applicant: CANON KABUSHIKI KAISHA, Tokyo (JP)

(72) Inventors: Masaya Shimmachi, Kawasaki (JP); Junichi Kubokawa, Kawasaki (JP); Hideaki Matsumura, Kawasaki (JP); Yukimichi Kimura, Kawasaki (JP); Takahiro Kiuchi, Fuchu (JP); Koki Shimada, Kawasaki (JP); Yusuke Tanaka, Kawasaki (JP); Kyohei Sato, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/336,448

(22) Filed: Oct. 27, 2016

(65) Prior Publication Data

US 2017/0120603 A1 May 4, 2017

(30) Foreign Application Priority Data

Oct. 30, 2015 (JP) ..... 2015-214968

(51) Int. Cl.
*B41J 2/175* (2006.01)
*B41J 29/02* (2006.01)

(52) U.S. Cl.
CPC ..... *B41J 2/175* (2013.01); *B41J 2/17509* (2013.01); *B41J 29/02* (2013.01)

(58) Field of Classification Search
CPC ..... B41J 2/175; B41J 2/1752; B41J 2/17553; B41J 29/02; B41J 29/13
See application file for complete search history.

(56) References Cited

U.S. PATENT DOCUMENTS

| | | | | |
|---|---|---|---|---|
| 5,291,224 | A * | 3/1994 | Asano | B41J 13/076 101/425 |
| 6,481,838 | B1 | 11/2002 | Brugue | |
| 2007/0091152 | A1 | 4/2007 | Rademakers | |
| 2011/0018948 | A1 | 1/2011 | Justice | |
| 2011/0148983 | A1* | 6/2011 | Sekino | B41J 2/175 347/37 |

FOREIGN PATENT DOCUMENTS

| | | | |
|---|---|---|---|
| CN | 1517221 | A | 8/2004 |
| CN | 101642979 | A | 2/2010 |
| CN | 102101390 | A | 6/2011 |
| JP | 2002-001987 | A | 1/2002 |
| JP | 2003-200595 | A | 7/2003 |
| JP | 2005-335230 | A | 12/2005 |
| JP | 2010-023388 | A | 2/2010 |

* cited by examiner

*Primary Examiner* — Sharon A Polk
(74) *Attorney, Agent, or Firm* — Canon U.S.A. Inc., IP Division

(57) ABSTRACT

The printing apparatus according to the present invention includes a carriage, a supply tube, a head set cover that moves to a first orientation at which the printing head is fixed to the carriage and a second orientation at which the printing head is attachable to or detachable from the carriage, and a joint unit that moves to a first position connected to the printing head and a second position separated from the printing head, wherein the joint unit does not move to the first position from the second position when the head set cover moves to the first orientation from the second orientation, and moves to the second position from the first position in cooperation with movement of the head set cover when the head set cover moves to the second orientation from the first orientation.

14 Claims, 12 Drawing Sheets

PRINTING APPARATUS

BACKGROUND OF THE INVENTION

Field of the Invention

The present invention relates to a printing apparatus.

Description of the Related Art

Japanese Patent Application Laid-Open No. 2003-200595 discusses a printing apparatus including a carriage to which a printing head is attached detachably, a supply tube that supplies ink to the printing head, a joint unit that connects the supply tube to the printing head, and a cover that is arranged on the carriage in an openable-closable state. In the printing apparatus, workability in replacing the printing head is improved by positioning and fixing the printing head to the carriage while connecting and fixing the joint unit to the printing head in cooperation with the closing operation of the cover.

The technique described in Japanese Patent Application Laid-Open No. 2003-200595 is effective if positioning portions of the joint unit and the printing head are arranged in the positions relatively separated from a rotation center of the cover. However, in a case were the positioning portions of the joint unit and the printing head are arranged in the positions close to the rotation center of the cover, it may be difficult to vertically insert the joint unit that rotates together with the cover into the printing head. Therefore, in order to insert the joint unit into the printing head with certainty, the positioning portions of the joint unit and the printing head have to be arranged in the positions relatively separated from the rotation center of the cover, and thus there is a risk in which a size of the printing apparatus may be increased.

SUMMARY OF THE INVENTION

An advantage of some aspects of the present invention is to provide a printing apparatus capable of easily and reliably attaching and detaching a printing head to/from a carriage without increasing a size of the printing apparatus.

According to an aspect of the present invention, a printing apparatus includes a carriage configured to move with a printing head which discharges ink mounted thereon detachably, a supply tube configured to supply ink from an ink tank to the printing head, a head set cover rotatably and axially supported by the carriage, configured to move to a first orientation at which the printing head is fixed to the carriage and a second orientation at which the printing head is attachable to or detachable from the carriage, and a joint unit arranged on the head set cover, configured to move to a first position connected to the printing head for supplying ink from the ink tank to the printing head via the supply tube and a second position separated from the printing head, wherein the joint unit does not move to the first position from the second position when the head set cover moves to the first orientation from the second orientation, and moves to the second position from the first position in cooperation with movement of the head set cover when the head set cover moves to the second orientation from the first orientation.

Further features of the present invention will become apparent from the following description of exemplary embodiments with reference to the attached drawings.

DESCRIPTION OF THE EMBODIMENTS

Hereinafter, an ink jet printing apparatus (printing apparatus) according to a first exemplary embodiment of the present invention will be described in detail with reference to the appended drawings.

Figure 1:
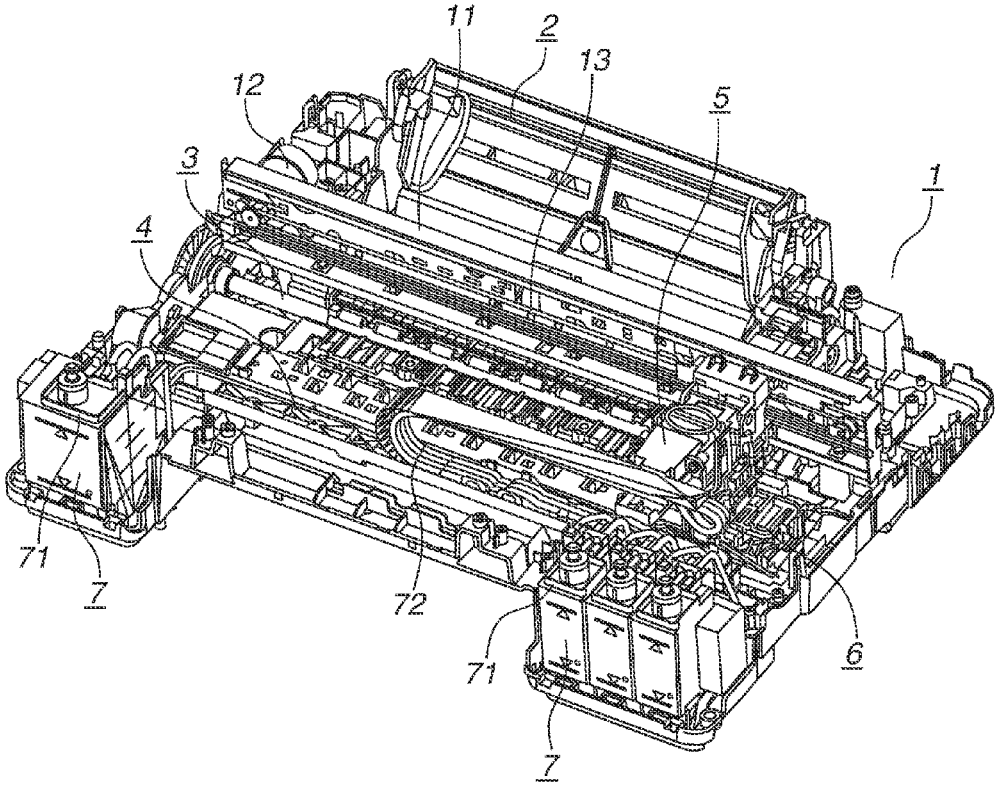
FIG. 1 is a diagram illustrating a perspective view of an ink jet printing apparatus according to a first exemplary embodiment.
Figure 2:
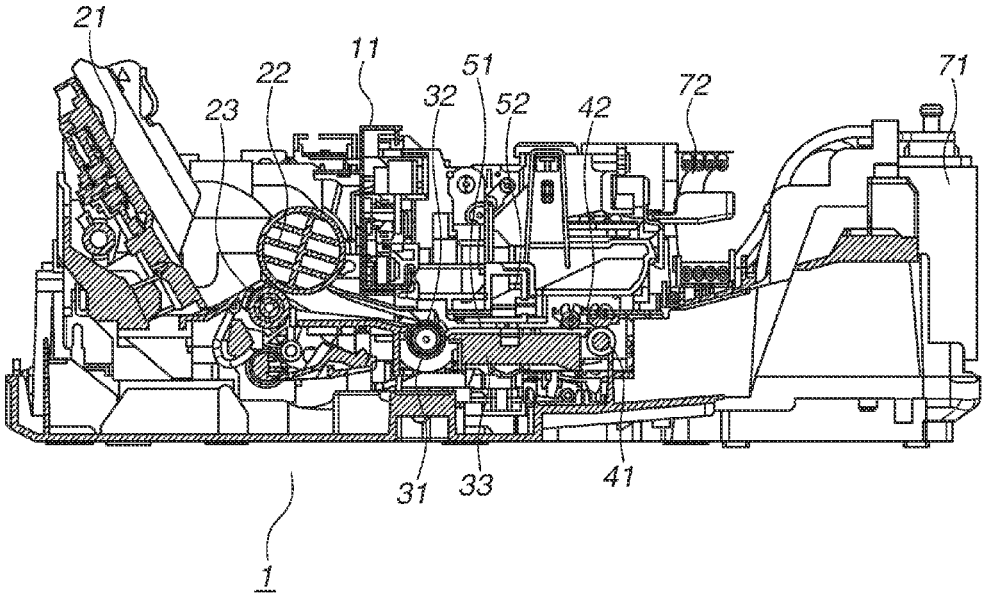
FIG. 2 is a diagram illustrating a cross-sectional view of the ink jet printing apparatus according to the first exemplary embodiment.

FIG. 1 is a diagram illustrating a perspective view of the ink jet printing apparatus according to the exemplary embodiment of the present invention. FIG. 2 is a diagram illustrating a cross-sectional view of the ink jet printing apparatus according to the exemplary embodiment of the present invention.

The ink jet printing apparatus 1 includes a feeding unit 2 for feeding a sheet (printing medium), a conveyance unit 3 for conveying the printing medium, a discharge unit 4 for discharging the printing medium, and a printing unit 5 for printing an image on the printing medium. The ink jet printing apparatus 1 further includes a maintenance unit 6 and an ink supply unit 7 described below.

Printing media stacked on a pressing plate 21 at the feeding unit 2 are separated and fed to the conveyance unit 3 by a pick-up roller 22 and a separation roller 23. A printing medium fed to the conveyance unit 3 abuts on a main conveyance roller 31 and a driven roller 32 that stop or rotate in a reverse direction, so that a positional skew of the printing medium is corrected thereby (i.e., skew correction operation). Thereafter, the printing medium is held between the main conveyance roller 31 and the driven roller 32, so as to be conveyed to the printing unit 5. The printing medium conveyed to the printing unit 5 is supported by a platen 33 from the underneath thereof, and ink is discharged onto the printing medium from a printing head 51 arranged in a position facing the platen 33, so that an image is formed thereon.

The printing head 51 is detachably mounted by the carriage 52. In a state where the printing head 51 is mounted by the carriage 52, the carriage 52 is supported by a chassis 11 so as to be movable in a direction (second direction) intersecting with a conveyance direction (first direction) of the printing medium. The carriage 52 moves in the second direction when a driving force from a carriage driving motor 12 is transmitted to a transmission belt 13. When the carriage 52 is moving in the second direction, the printing head 51 discharges ink onto the printing medium and forms one-band worth of image. The printing medium on which the one-band worth of image is formed is intermittently conveyed in the first direction by a predetermined conveyance amount in order to form next one-band worth of image. The intermittent conveyance operation and the image forming operation are executed alternately and repeatedly, so that an image is formed on the entirety of the printing medium. The printing medium on which the image is formed is conveyed to the discharge unit 4. The printing medium conveyed to the discharge unit 4 is discharged to a discharge tray (not illustrated) by a discharge roller 41 and a spur roller 42.

A maintenance unit 6 for performing maintenance work on the printing head 51 is arranged at an end portion of a movable region of the carriage 52. The maintenance unit 6 includes a cap that covers an ink discharge port arranged on the printing head 51. It is possible to prevent drying of ink caused by the ink discharge port by covering the ink discharge port with the cap. Further, the maintenance unit 6 includes a suction recovery mechanism in which ink is sucked from the ink discharge port in a capped state through a tube and a pump in order to recover the printing performance of the printing head 51.

The ink supply unit 7 is arranged on a front face of a main unit of the ink jet printing apparatus 1. The ink supply unit 7 includes an ink tank 71 for containing ink in the inside thereof. The ink tank 71 has an ink filling port through which ink is supplied thereto. A user can replenish the ink tank 71 with ink by supplying the ink through the ink filling port. The ink contained within the ink tank 71 is supplied to the printing head 51 via a supply tube 72. Because the ink is supplied from the ink tank 71, the printing head 51 can form an image on the printing medium by discharging ink in a printing period.

Next, a configuration of a carriage unit according to a characteristic portion of the present invention will be described in detail with reference to FIGS. 3 to 8.

The carriage unit is arranged on the printing unit 5. The carriage unit is a unit including the carriage that detachably mounts the printing head 51. As described above, the carriage 52 is movable in the second direction while mounting the printing head 51. A head set cover 53 that covers the attached printing head 51 is arranged on the carriage 52.

Figure 3:
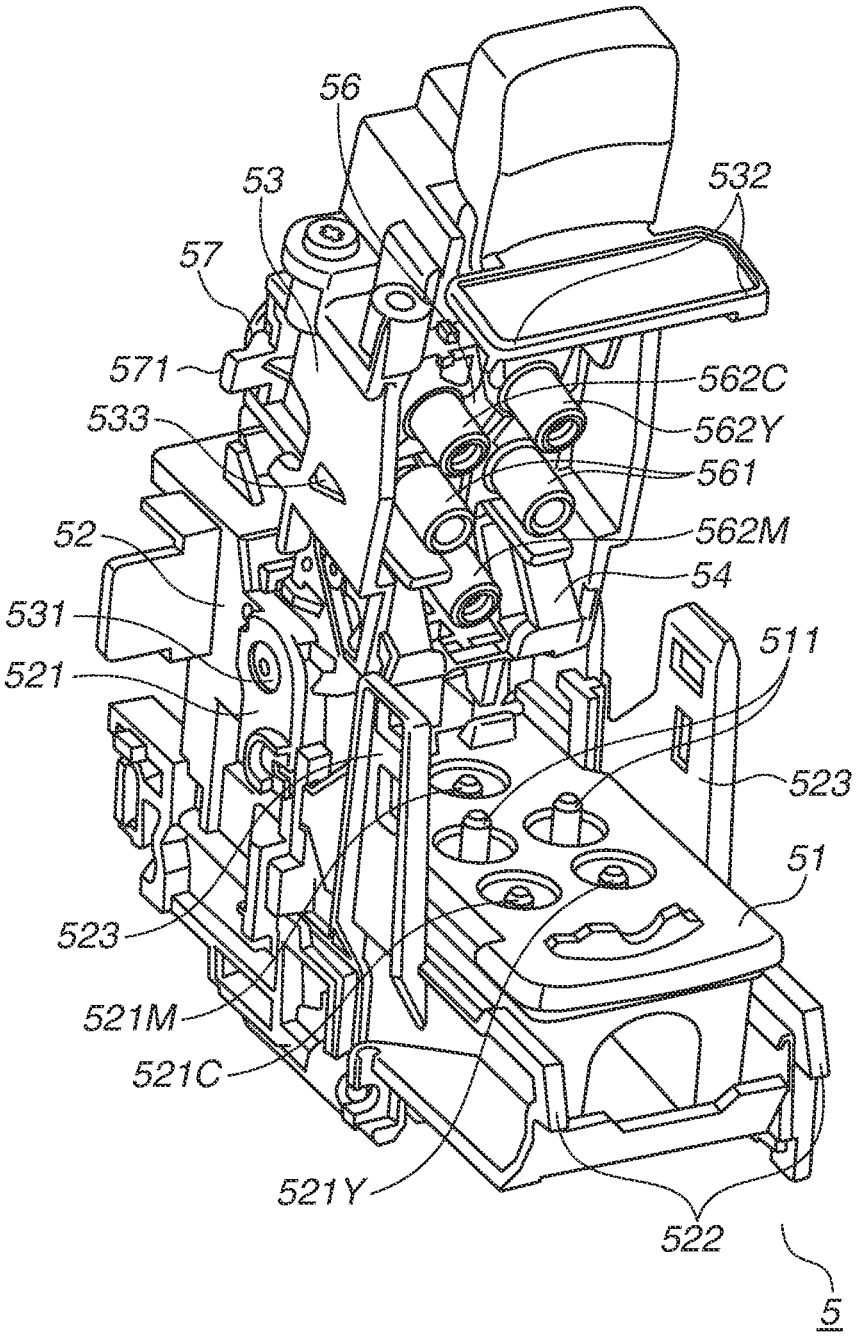
FIG. 3 is a diagram illustrating a perspective view of a carriage unit according to the first exemplary embodiment with a cover opened.
Figure 4:
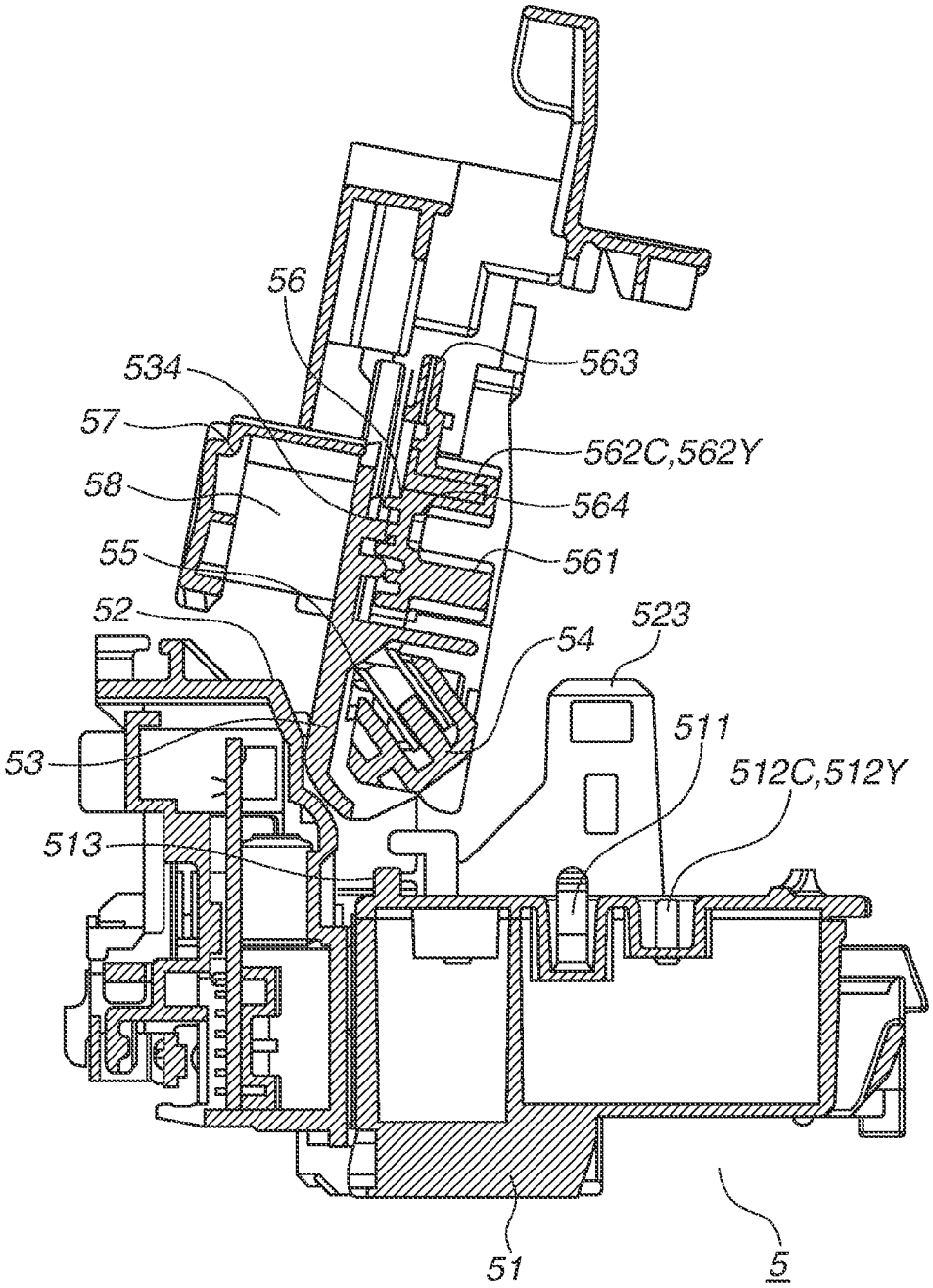
FIG. 4 is a diagram illustrating a cross-sectional view of the carriage unit according to the first exemplary embodiment with the cover opened.
Figure 5:
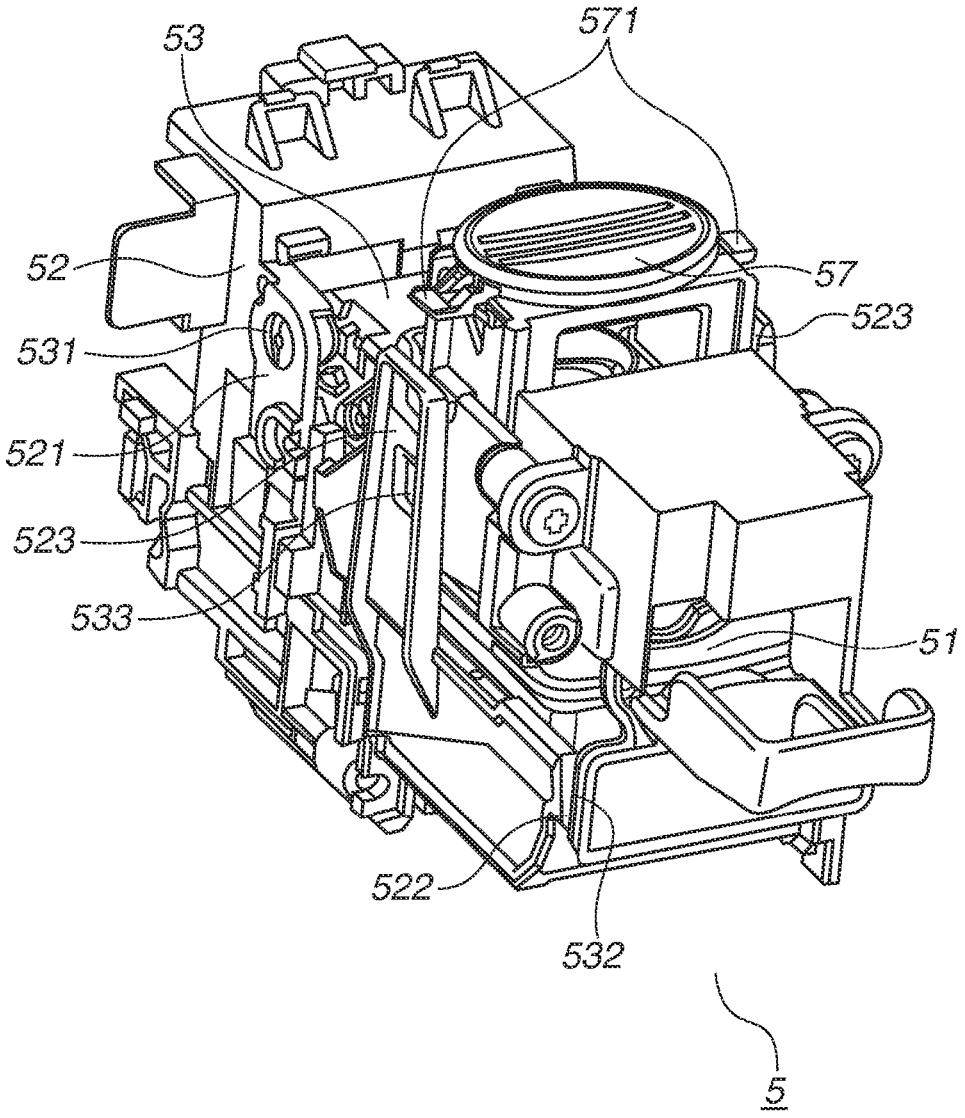
FIG. 5 is a diagram illustrating a perspective view of the carriage unit according to the first exemplary embodiment with the cover closed.
Figure 6:
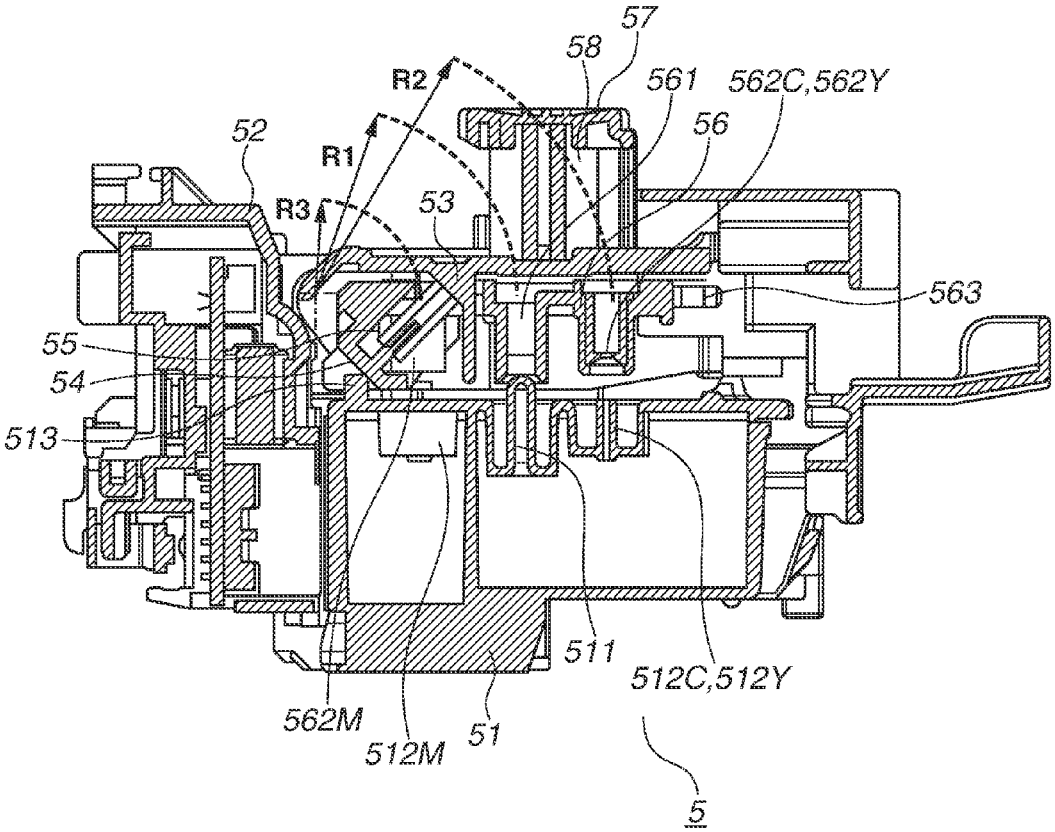
FIG. 6 is a diagram illustrating a cross-sectional view of the carriage unit according to the first exemplary embodiment with the cover closed.
Figure 7:
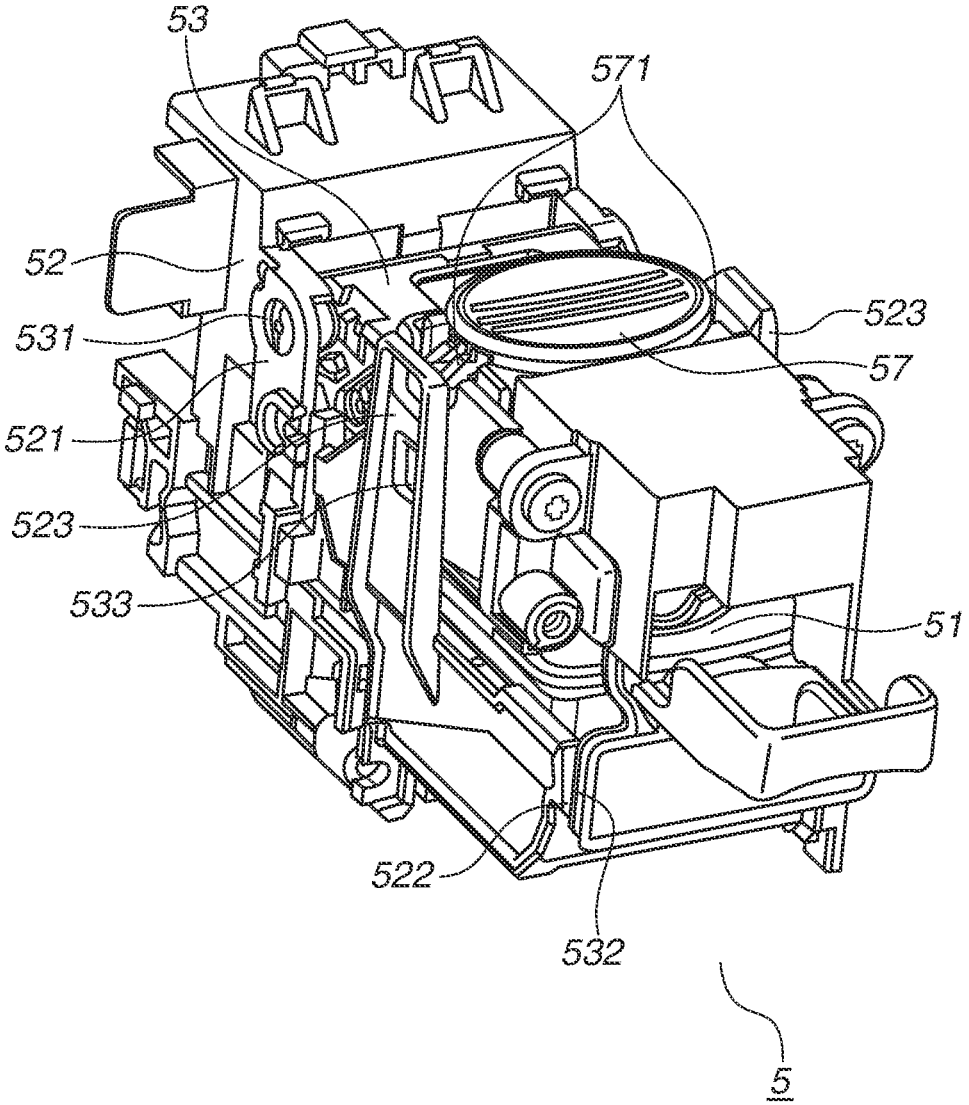
FIG. 7 is a diagram illustrating a perspective view of the carriage unit according to the first exemplary embodiment with a joint inserted.
Figure 8:
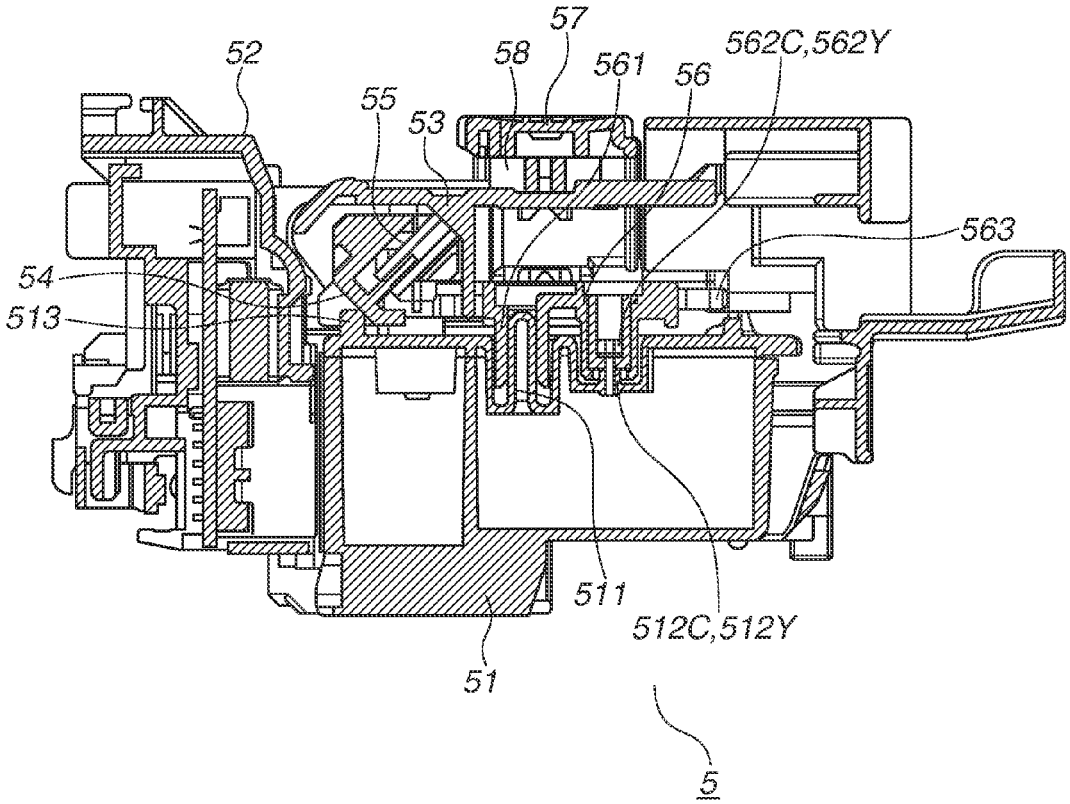
FIG. 8 is a diagram illustrating a cross-sectional view of the carriage unit according to the first exemplary embodiment with the joint inserted.

FIGS. 3 and 4 are a perspective view and a cross-sectional view of the carriage unit with the head set cover 53 opened. FIGS. 5 and 6 are a perspective view and a cross-sectional view of the carriage unit with the head cover 53 closed. FIGS. 7 and 8 are a perspective view and a cross-sectional view of the carriage unit with a joint inserted thereto.

The head set cover 53 is rotatably and axially supported by the carriage 52 by making a shaft bearing portion 521 as a rotation center. The head set cover 53 is urged by an urging member (not illustrated), so as to be held in a state (second orientation) where the head set cover 53 is opened as illustrated in FIGS. 3 and 4.

When the head set cover 53 is tilted downward in the state where the head set cover 53 is opened (see FIGS. 3 and 4), the head set cover 53 is brought into a closed state (first orientation) as illustrated in FIGS. 5 and 6. In a state where the head set cover 53 is closed, regulation portions 522 arranged on the carriage 52 engage with claw portions 532 arranged on the head set cover 53. With this configuration, the head set cover 53 is fixed in a closed state.

A head set cam 54 and a head set cam spring 55 that urges the head set cam 54 are arranged on the head set cover 53. When the head set cover 53 is closed, an abutting portion 513 arranged on the printing head 51 abuts on the urged head set cam 54, so that a position of the printing head 51 is fixed (see FIG. 6).

A joint unit 56 is arranged on the head set cover 53. An ink inlet port 563 is arranged on the joint unit 56. One end of the supply tube 72 is connected to the ink inlet port 563. Another end of the supply tube 72 is connected to the ink tank 71.

The joint unit 56 can be moved in the upper and lower directions with respect to the head set cover 53 by the joint lever 57. The joint unit 56 is urged by a joint lever spring (urging unit) 58 from a lower position (first position) toward an upper position (second position). When the joint unit 56 is positioned in the upper position, a positioning portion 564 of the joint unit 56 engages with a positioning portion 534 of the head set cover 53. With this configuration, the joint unit 56 is positioned and fixed onto the head set cover 53 at the upper position.

When the joint lever 57 is pressed downward, the engagement between the positioning portion 564 of the joint unit 56 and the positioning portion 534 of the head set cover 53 is released, so that the positioning fixed thereto is cancelled. When the joint unit 56 moves to the lower position, claw portions 571 of the joint lever 57 engage with lock portions 523 arranged on the carriage 52. With this configuration, the joint unit 56 is fixed at the lower position, so that the movement of the joint unit 56 from the lower position to the upper position caused by the joint lever spring 58 is regulated thereby.

A plurality of shaft portions 511 for positioning the joint unit 56 and a plurality of ink supply ports 512 are arranged on the printing head 51 attached to the carriage 52. The ink supply ports 512 are arranged for ink of respective colors. In the present exemplary embodiment, a cyan ink supply port 512C, a magenta ink supply port 512M, and a yellow ink supply port 512Y are arranged thereon. Positioning portions 561 are arranged on the joint unit 56 so as to correspond to the shaft portions 511 of the printing head 51. Further, flexible lip portions 562 are arranged on the joint unit 56 so as to correspond to the ink supply ports 512. The lip portions 562 such as a cyan lip portion 562C, a magenta lip portion 562M, and a yellow lip portion 562Y are arranged so as to correspond to the ink supply ports 512 of ink of the respective colors.

The positioning portions 561 are arranged in a position at a distance R1 in the radius direction from the rotation center of the head set cover 53. The cyan lip portion 562C and the yellow lip portion 562Y are arranged in positions at a distance R2 that is greater than the distance R1 in the radius direction from the rotation center of the head set cover 53. The magenta lip portion 562M is arranged in a position at a distance R3 that is less than the distance R1 in the radius direction in the rotation center of the head set cover 53. Further, the shaft portions 511 and the ink supply ports 512 of the printing head 51 are arranged in such a positional relationship in which respective positions thereof correspond to the positions of the positioning portions 561 and the lip portions 562 of the joint unit 56 when the printing head 51 is attached to the carriage 52 (see FIGS. 3 and 6).

Next, operation for attaching the printing head 51 onto the carriage 52 will be described.

First, as illustrated in FIGS. 3 and 4, in a state where the head set cover 53 is opened, the user attaches the printing head 51 onto the carriage 52 and closes the head set cover 53. When the head set rover 53 is closed, the regulation portions 522 arranged on the carriage 52 engage with the claw portions 532 arranged on the head set cover 53. Then, the urged head set cam 54 abuts on the abutting portion 513 of the printing head 51, so that the printing head 51 is positioned and fixed to the carriage 52 (see FIGS. 5 and 6). At this state, the positioning portions 561 and the lip portions 562 of the joint unit 56 are still separated from the shaft portions 511 and the ink supply ports 512 of the printing head 51.

Thereafter, when the joint lever 57 is pressed downward, the engagement between the positioning portion 564 of the joint unit 56 and the positioning portion 534 of the head set cover 53 is released, and the joint lever 57 moves to the lower position from the upper position. At this time, the positioning portions 561 of the joint unit 56 are guided to the shaft portions 511 of the printing head 51, and the lip portions 562 (562C, 562M, and 562Y) are respectively inserted into the ink supply ports 512 (512C, 512M, and 512Y). With this operation, the joint unit 56 and the printing head 51 interlock with each other, so that the ink can be supplied to the printing head 51 from the ink tank 71 (see FIGS. 7 and 8). At this time, the claw portions 571 of the joint lever 57 engage with the lock portions 523 arranged on the carriage 52. With this configuration, the movement of the joint lever 57 toward the upper position caused by the joint lever spring 58 is regulated.

Next, operation for removing the printing head 51 from the carriage 52 will be described.

First, in a state where the printing head 51 is attached to the carriage 52 as illustrated in FIGS. 7 and 8, the user opens the head set cover 53 by releasing the engagement between the regulation portions 522 of the carriage 52 and the claw portions 532 of the head set cover 53. At the same time as the head set cover 53 is opened, the lock portions 523 are pushed and widened by lock release portions 533 integrally formed on the side faces of the head set cover 53, so that the engagement between the claw portions 571 of the joint lever 57 and the lock portions 523 of the carriage 52 is released. With this operation, the joint lever 57 becomes movable in the upper and the lower directions. The joint lever 57 is urged toward the upper position from the lower position by the joint lever spring 58. Therefore, the joint lever 57 moves to the upper position. As described above, when the head set cover 53 is opened in the state illustrated in FIGS. 7 and 8, the joint lever 57 also moves to the upper position simultaneously, so that the head set cover 53 is brought into the open state as illustrated in FIGS. 3 and 4. Here, the positioning portion 564 of the joint unit 56 and the positioning portion 534 of the head set cover 53 engage with each other, so that the joint unit 56 is positioned and fixed to the head set cover 53 at the upper position. In this state, the user can remove the printing head 51 from the carriage 52.

As described above, according to the present exemplary embodiment, it is possible to easily and reliably attach and detach the printing head to/from a carriage without increasing a size of the printing apparatus.

Further, in the present exemplary embodiment, although the lip portions are arranged on the joint unit, the present invention is not limited thereto, and the lip portions may be arranged on the printing head. Further, in the present exemplary embodiment, although the ink supply ports and the lip portions are respectively arranged in the positions at the distances R2 and R1 from the rotation center while the positioning portions are arranged in the position at the distance R1 from the rotation center, the present invention is not limited thereto, and the respective portions are arranged in the optional positions. Further, only a plurality of ink supply portions and lip portions may be arranged in different positions without arranging the positioning portions.

Figure 9:
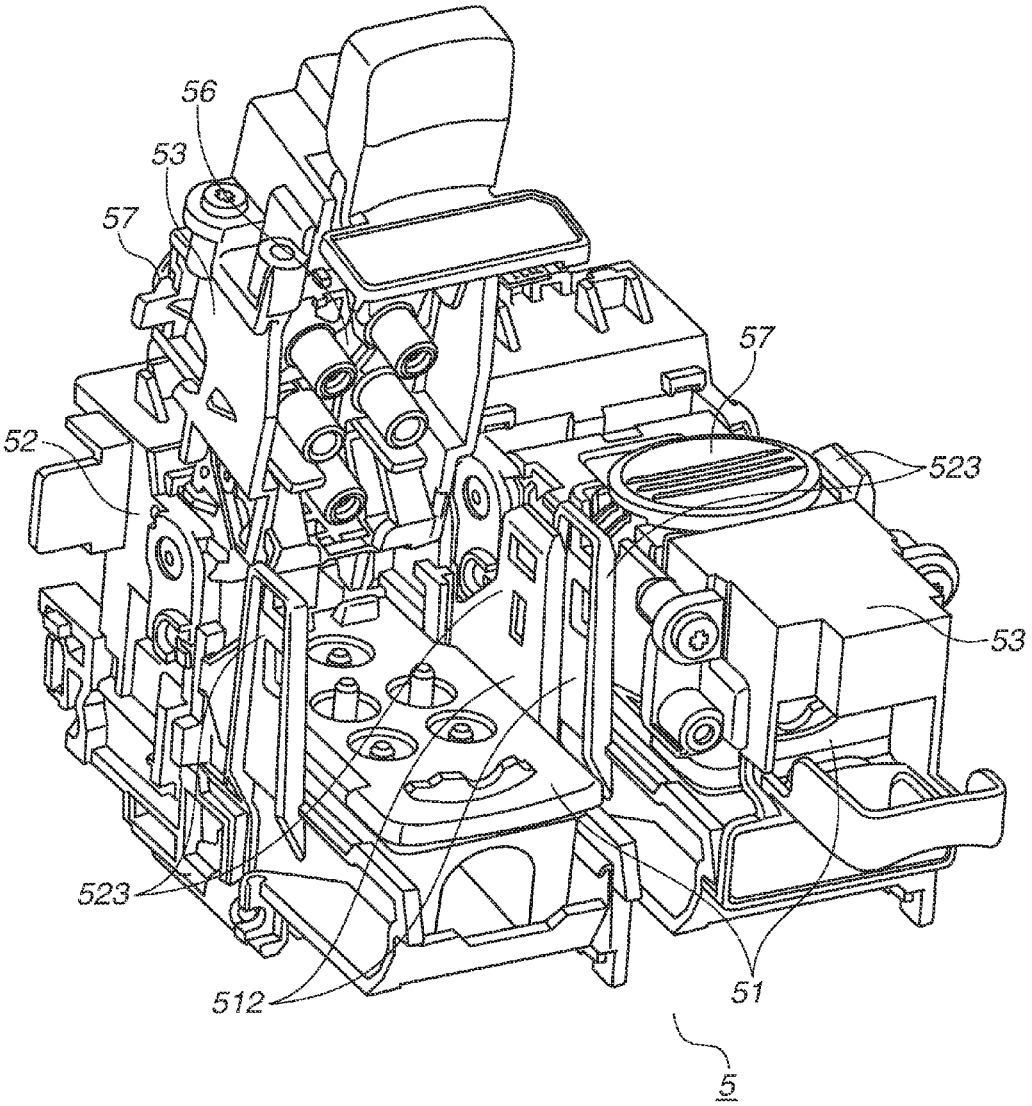
FIG. 9 is a diagram illustrating a perspective view of the carriage unit according to the first exemplary embodiment, in which a plurality of printing heads is arranged.

Further, as illustrated in FIG. 9, in a case where a plurality of printing heads is to be attached to the carriage, head set covers and joint portions corresponding to respective printing heads may be arranged.

Next, an ink jet printing apparatus according to a second exemplary embodiment will be described, in addition, only the configurations different from the configurations of the first exemplary embodiment will be described while description of the configurations the same as those described in the first exemplary embodiment will be omitted.

Figure 11:
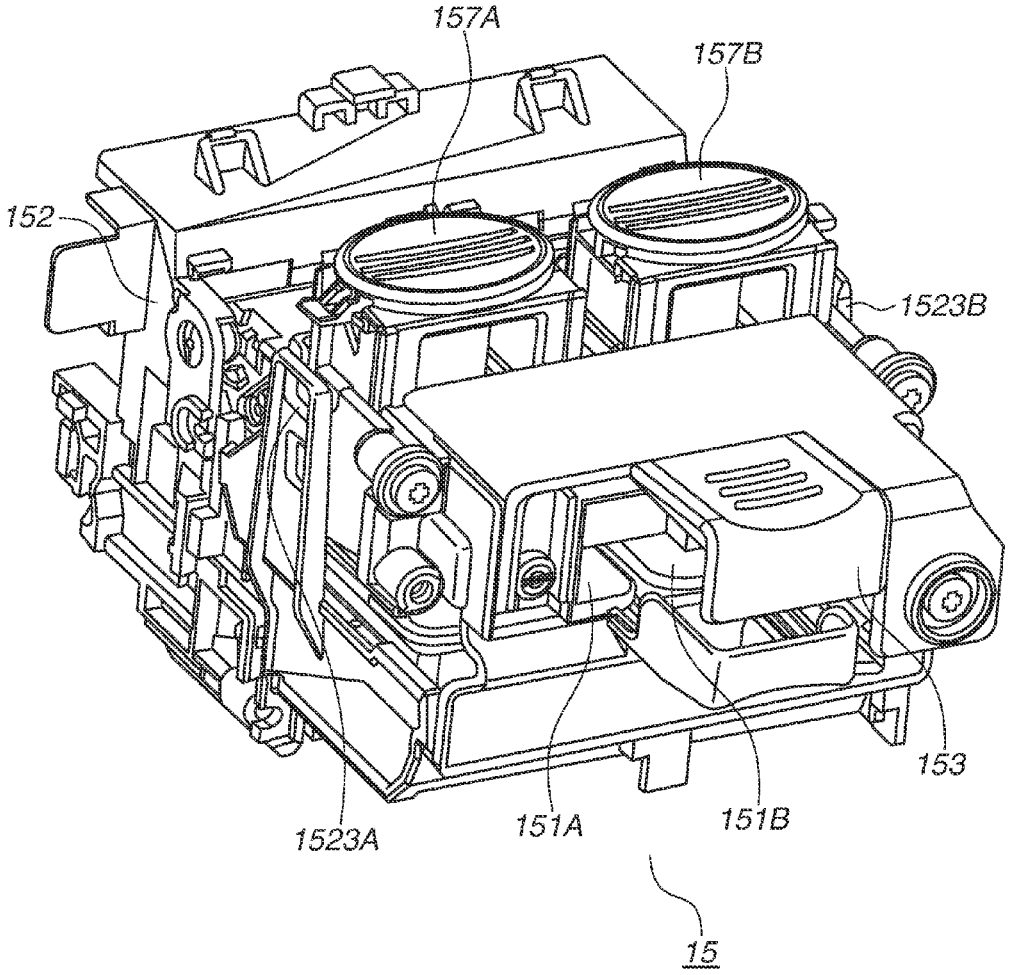
FIG. 11 is a diagram illustrating a perspective view of the carriage unit according to the second exemplary embodiment with the cover closed.
Figure 12:
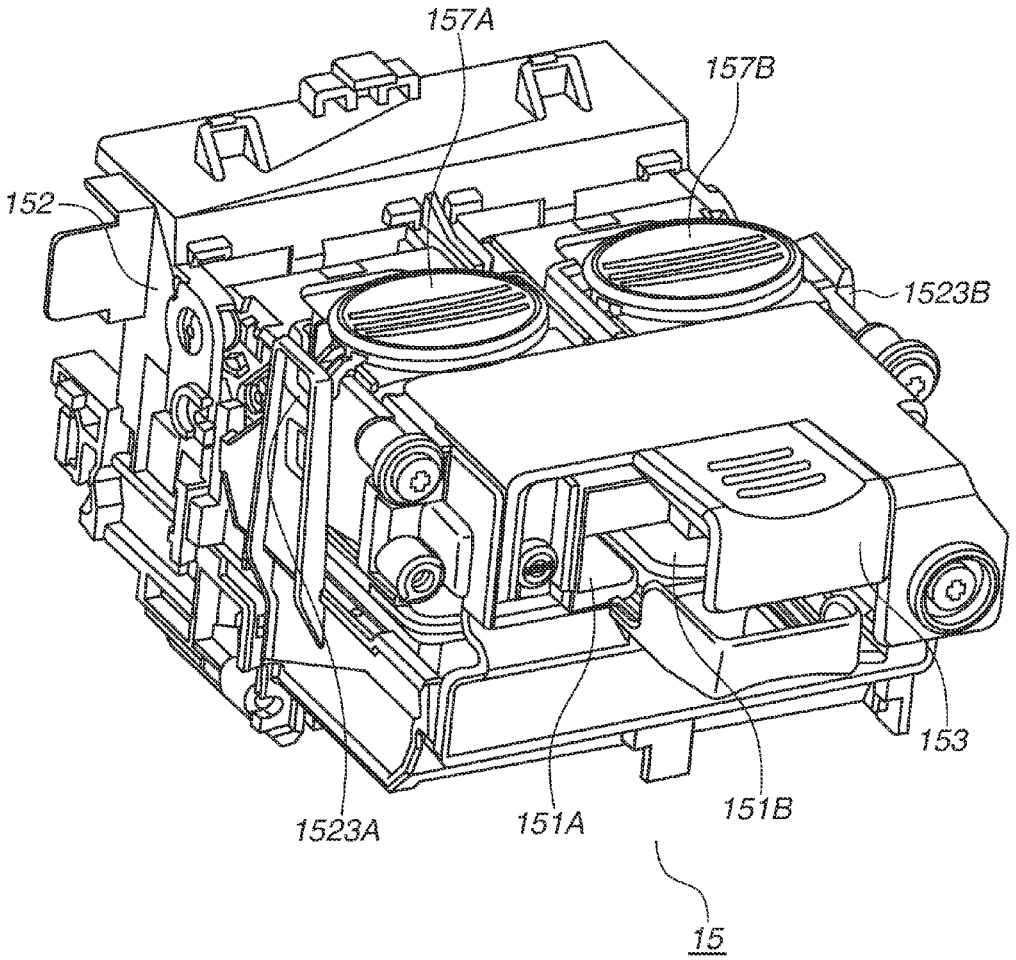
FIG. 12 is a diagram illustrating a perspective view of the carriage unit according to the second exemplary embodiment with a joint inserted.

A configuration of a carriage unit according to the present exemplary embodiment will be described with reference to FIGS. 10 to 12. In the present exemplary embodiment, two printing heads 151A and 151B are attached with respect to a single carriage 152 and a single head set cover 153. Here, the printing heads 151A and 151B are selectively used for the ink of respective colors. For example, in the present exemplary embodiment, the printing head 151A is used for color ink (cyan (C), magenta (M), and yellow (Y)), whereas the printing head 151B is used for black ink (black (Bk)).

Similar to the first exemplary embodiment, the head set cover 153 is rotatably and axially supported by the carriage 152. Joint units 156A, 156B, and joint levers 157A, 157B are arranged on the head set cover 153 so as to be movable in the upper and lower directions.

Similar to the first exemplary embodiment, positioning portions 1561A, 1561B, and lip portions 1562A, 1562B are respectively arranged on the joint units 156A and 156B. Further, shaft portions 1511A and ink supply ports 1512A are arranged on the printing head 151A in such a positional relationship in which respective positions thereof correspond to the positions of the positioning portions 1561A and the lip portions 1562A when the printing head 151A is attached to the carriage 152. Similarly, shaft portions 1511B and an ink supply port 1512B are arranged on the printing head 151B in such a positional relationship in which respective positions thereof correspond to the positions of the positioning portions 1561B and the lip portion 1562B when the printing head 151B is attached to the carriage 152.

Figure 10:
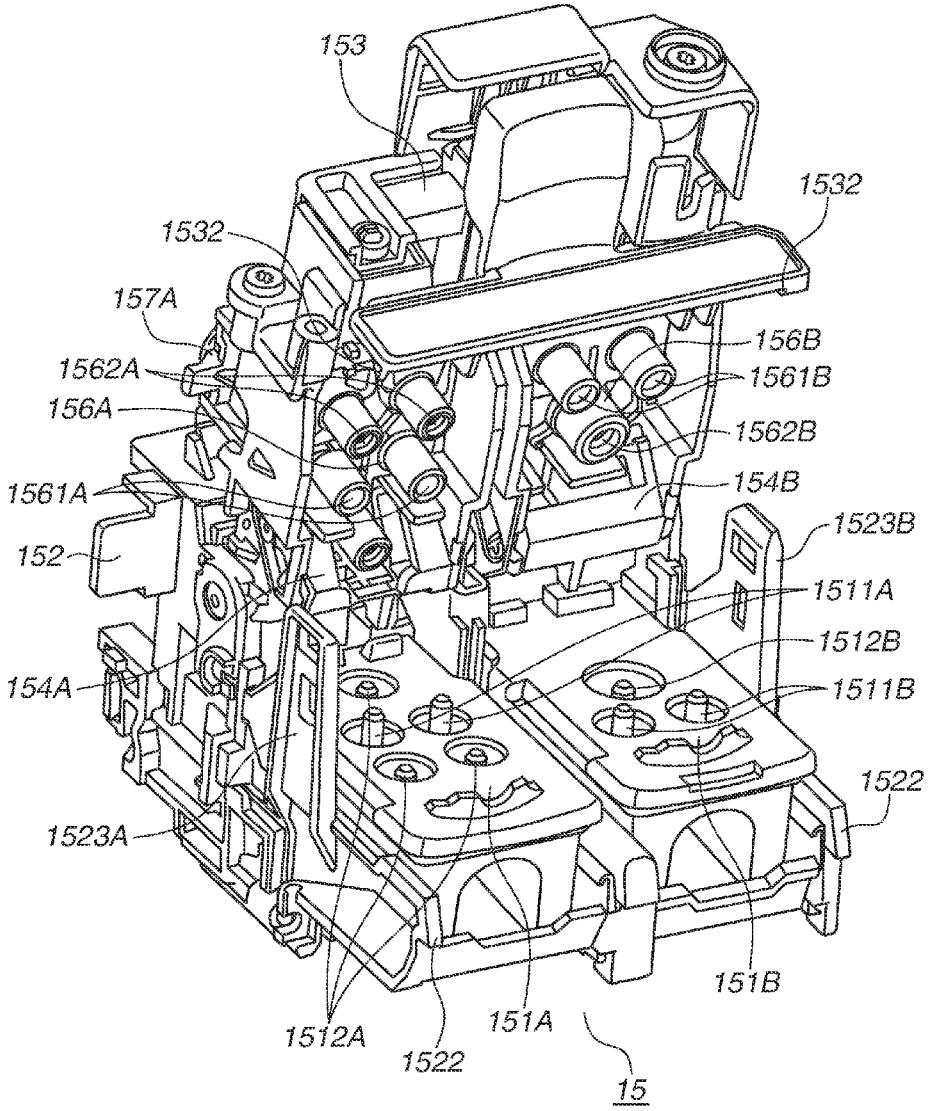
FIG. 10 is a diagram illustrating a perspective view of a carriage unit according to a second exemplary embodiment with a cover opened.

FIG. 10 is a diagram illustrating a perspective view of the carriage unit with the head set cover 153 opened. FIG. 11 is a diagram illustrating a perspective view of the carriage unit with the head set cover 153 closed. FIG. 12 is a diagram illustrating a perspective view of the carriage unit with a joint inserted thereto.

The head set cover 153 is tilted downward in the state where the head set cover 153 is opened as illustrated in FIG. 10. Then, regulation portions 1522 arranged on the carriage 152 and claw portions 1532 arranged on the head set cover 153 engage with each other, so that the head set cover 153 is fixed in a closed state as illustrated in FIG. 11. Then, the printing heads 151A and 151B respectively abut on head set cams 154A and 154B arranged on the head set rover 153, so that the printing heads 151A and 151B are positioned and fixed to the carriage 152.

Then, when the joint levers 157A and 157B are pressed downward, the positioning portions 1561A and 1561B are respectively guided to the shaft portions 1511A and 1511B, and the lip portions 1562A and 1562B are inserted into the ink supply ports 1512A and 1512B respectively. With this operation, as illustrated in FIG. 12, the joint units 156A, 156B and the printing heads 151A, 151B respectively interlock with each other, so that the ink can be supplied to the printing heads 151A and 151B from the ink tanks of respective colors. At this time, the joint levers 157A and 157B engage with lock portions 1523A and 1523B of the carriage 152 respectively. With this configuration, the movement of the joint levers 157A and 157B toward the upper positions caused by the joint lever spring is regulated.

As described above, by using a single carriage and a single head set cover with respect to a plurality of printing heads, a width of the printing unit can be narrower in comparison to the configuration in which two printing heads are arranged as illustrated in FIG. 9, described in the first exemplary embodiment. Accordingly, the printing apparatus can be miniaturized while an internal space thereof can be conserved efficiently, and thus it is possible to improve a degree of freedom in design such as arrangement of the supply tube. Further, as it is possible to reduce the operation steps necessary for the user, convenience of attaching and detaching the printing head can be improved further.

In other words, according to the present invention, it is possible to provide an ink jet printing apparatus capable of reliably and easily attaching and detaching a printing head to/from a carriage without increasing a size of the printing apparatus.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-214968, filed Oct. 30, 2015, which is hereby incorporated by reference herein in its entirety.

What is claimed is:

1. A printing apparatus comprising:

a carriage configured to move with a printing head which discharges ink mounted thereon detachably;

a supply tube configured to supply ink from an ink tank to the printing head;

a head set cover rotatably and axially supported by the carriage, configured to move to a first orientation at which the printing head is fixed to the carriage and a second orientation at which the printing head is attachable to or detachable from the carriage; and a joint unit arranged on the head set cover, configured to move to a first position connected to the printing head for supplying ink from the ink tank to the printing head via the supply tube and a second position separated from the printing head, wherein the joint unit does not move to the first position from the second position when the head set cover moves to the first orientation from the second orientation, and moves to the second position from the first position in cooperation with movement of the head set cover when the head set cover moves to the second orientation from the first orientation.

2. The printing apparatus according to claim 1, wherein the joint unit is configured to move to the first position from the second position when the head set cover is positioned in the first orientation.

3. The printing apparatus according to claim 1 further comprising an urging unit configured to urge the joint unit toward the second position from the first position.

4. The printing apparatus according to claim 1, wherein the joint unit has a claw portion, and wherein the carriage has a lock portion which regulates movement of the joint unit toward the second position by engaging the claw portion of the joint unit when the head set cover is positioned in the first orientation and the joint unit has moved to the first position from the second position.

5. The printing apparatus according to claim 4, wherein the head set cover has a lock release portion which releases engagement between the claw portion of the joint unit and the lock portion of the carriage when the head set cover moves to the second orientation from the first orientation.

6. The printing apparatus according to claim 5, wherein the lock release portion is formed integrally with the head set cover.

7. The printing apparatus according to claim 1, further comprising an urging member configured to urge the head set cover so as to hold the set cover in the second orientation.

8. The printing apparatus according to claim 1, wherein the head set cover has a claw portion, and the carriage has a regulation portion which regulates movement of the head set cover toward the second orientation by engaging with the claw portion of the head set cover when the head set cover is positioned in the first orientation.

9. The printing apparatus according to claim 1, wherein the head set cover has a head set cam and a head set cam spring that urges the head set cam, and the head set cam urged by the head set cam spring fixes the printing head to the carriage by abutting on the printing head when the head set cover is positioned in the first orientation.

10. The printing apparatus according to claim 1, wherein the joint unit has a positioning portion which fixes the joint unit to the head set cover by engaging with a positioning portion of the head set cover when the joint unit is positioned in the second position.

11. The printing apparatus according to claim 10, wherein engagement between the positioning portion of the joint unit and the positioning portion of the head set cover is released when the joint unit moves to the first position from the second position.

12. The printing apparatus according to claim 1, wherein, in order to supply ink from the ink tank to the printing head when the joint unit is positioned in the first position, the joint unit includes lip portions for interlocking with the printing head, and wherein the plurality of lip portions is arranged in positions at different distances in a radius direction from a rotation center of the head set cover.

13. The printing apparatus according to claim 1, wherein the joint unit includes a positioning portion for fixing a position of the printing head when the joint unit is positioned in the first position and a lip portion for interlocking with the printing head in order to supply ink from the ink tank to the printing head when the joint unit is positioned in the first position, and wherein the positioning portion and the lip portion are arranged in positions at different distances in a radius direction from a rotation center of the head set cover.

14. The printing apparatus according to claim 1, wherein the carriage detachably mounts a plurality of printing heads, and wherein the head set cover fixes the plurality of printing heads at the first orientation, and detachably mounts the plurality of printing head at the second orientation.

* * * * *